US009555319B2

(12) United States Patent
Jones

(10) Patent No.: US 9,555,319 B2
(45) Date of Patent: Jan. 31, 2017

(54) TABLE GAME SYSTEM

(71) Applicant: Mark H. Jones, Gardnerville, NV (US)

(72) Inventor: Mark H. Jones, Gardnerville, NV (US)

( * ) Notice: Subject to any disclaimer, the term of this patent is extended or adjusted under 35 U.S.C. 154(b) by 0 days.

(21) Appl. No.: 14/520,815

(22) Filed: Oct. 22, 2014

(65) Prior Publication Data

US 2015/0108717 A1 Apr. 23, 2015

Related U.S. Application Data

(60) Provisional application No. 61/894,481, filed on Oct. 23, 2013.

(51) Int. Cl.

| | |
|---|---|
| ***A63F 3/00*** | (2006.01) |
| ***G07F 17/32*** | (2006.01) |
| *A63F 1/12* | (2006.01) |
| *A63F 9/24* | (2006.01) |

(52) U.S. Cl.

CPC ..... *A63F 3/00157* (2013.01); *G07F 17/322* (2013.01); *A63F 1/12* (2013.01); *A63F 2003/00164* (2013.01); *A63F 2009/2451* (2013.01); *A63F 2009/2454* (2013.01); *G07F 17/3293* (2013.01)

(58) Field of Classification Search

CPC ..... A63F 3/00157; A63F 3/00164; A63F 2003/00646; A63F 2003/00662; A63F 2003/00826

USPC ..... 273/309, 274; 463/30, 31; 362/234, 362/249.06

See application file for complete search history.

(56) References Cited

U.S. PATENT DOCUMENTS

| | | | | |
|---|---|---|---|---|
| 6,283,856 | B1 * | 9/2001 | Mothwurf | G07F 17/32 273/138.2 |
| 8,074,991 | B2 * | 12/2011 | Chen | A63F 3/00157 273/138.1 |
| 8,177,628 | B2 * | 5/2012 | Manning | G06Q 20/3224 273/138.1 |
| 8,684,360 | B2 * | 4/2014 | van Linden | A63F 13/08 273/309 |
| 2004/0036219 | A1 * | 2/2004 | Schibetta | A63F 3/00157 273/292 |
| 2005/0285341 | A1 * | 12/2005 | Terminel | A63F 3/00157 273/292 |
| 2006/0217169 | A1 * | 9/2006 | Manber | A63F 3/00157 463/16 |
| 2009/0170595 | A1 * | 7/2009 | Walker | G07F 1/06 463/25 |
| 2009/0227312 | A1 * | 9/2009 | Lima | G07F 17/3293 463/13 |
| 2010/0295246 | A1 * | 11/2010 | Anderson | A63F 3/00157 273/274 |

(Continued)

*Primary Examiner* — William Pierce

(74) *Attorney, Agent, or Firm* — John S. Artz; Dickinson Wright, PLLC

(57) ABSTRACT

An improved game surface for a table game system includes a random number generator for identifying one or more numbers relevant to determining an outcome of a game of chance. The table game surface includes a game layout, including a plurality of player positions and a plurality of wagering areas corresponding to different possible outcomes. Each wagering area includes at least one illumination source associated therewith that can be switched between an on condition and an off condition. Each at least one illumination source may be configured to switch to the on condition when the wagering area with which it is associated is a winning outcome.

25 Claims, 3 Drawing Sheets

(56) References Cited

U.S. PATENT DOCUMENTS

| | | | | |
|---|---|---|---|---|
| 2011/0223983 | A1* | 9/2011 | Schwartz | G07F 17/3211 463/17 |
| 2011/0309578 | A1* | 12/2011 | Lambert | G07F 17/32 273/274 |
| 2011/0309580 | A1* | 12/2011 | Zussman | A63F 3/00157 273/292 |
| 2012/0122559 | A1* | 5/2012 | Kelly | G07F 17/322 463/25 |
| 2014/0191471 | A1* | 7/2014 | Park | A63F 1/18 273/237 |

* cited by examiner

TABLE GAME SYSTEM

CROSS-REFERENCE TO RELATED APPLICATIONS

The present application claims priority to U.S. Provisional Patent Application Ser. No. 61/894,481 entitled "Improved Table Game System", which was filed on Oct. 23, 2013, which is hereby incorporated by reference as though set forth fully herein.

TECHNICAL FIELD

The present disclosure relates generally to a table game of chance. More specifically, the present disclosure relates to a table game system and game layout for a table game of chance that provides increased user enjoyment.

BACKGROUND OF THE DISCLOSURE

Games of chance are well known activities whose outcomes are strongly influenced by randomizing devices and upon which players may wager money as they forecast outcomes. Common randomizing devices include dice, spinning tops, playing cards, roulette wheels, prize wheels, and numbered balls drawn from containers. Games of chance have been played throughout all of human history and are considered to be a popular pastime by many. Players of games of chance are attracted to new and exciting methods of game play as well as new and exciting randomizing devices and table game layouts. For this reason, the gaming industry is continuously developing new games, new randomizing devices and new table game layouts to maintain player interest and attract new players as more game play means increased revenue for the gamer operator.

Games of chance that include money wagers are typically regulated by governing authorities. These governing authorities enforce laws and regulations that are enacted to curtail certain kinds of games as well as certain kinds of randomizing devices in order to minimize irregularities and possible cheating. For example, in some jurisdictions, the use of dice or roulette wheels to resolve a game outcome, i.e., as the randomizing device, has been curtailed. Instead, randomizing devices that use playing cards have been more frequently utilized as they enjoy fewer restrictions in games of chance played for money than dice and roulette wheel randomizing devices.

Casino games typically include a playing surface, for example, a felt or cloth table betting layout, which generally includes a plurality of player positions distributed around the table. The betting layout also generally includes various wagering areas where players may place wagers on the outcome of the game. Once the outcome of the game of chance has been determined, i.e., a winning number or card selected, a dealer associated with the table typically resolves the wagers that have been placed in the various betting areas by paying out wagers made on the winning outcome and removing wagers that were made on non-winning outcomes. Before resolving the wagers, the dealer often uses a dolly marker or the like and places it on the layout in the appropriate wagering area to designate the winning outcome. This allows players to see the selected outcome and also assists the dealer in properly resolving the wagers made on the outcome. This process can be relatively cumbersome and if there are multiple winning outcomes, multiple markers are usually employed. Thus, players may not always be able to readily distinguish winning outcomes from losing outcomes.

Additionally, conventional dolly markers can sometimes be difficult to see and can be overlooked by the dealer, which can result in errors in the process of resolving any wagers made on the outcome of the game of chance. These dealer errors, also known as bleed, are known to cost casinos significant amounts of money each year.

It would thus be desirable to provide an improved layout for a table game of chance that minimizes the opportunity for dealer error and also increases player enjoyment.

SUMMARY OF THE INVENTION

It is therefore an aspect of the present disclosure to provide an improved game layout for a table game system that yields increased player enjoyment.

It is another aspect of the present disclosure to provide an improved game layout for a table game system that decreases the opportunity for dealer error and bleed.

It is still another aspect of the present disclosure to provide an improved game layout for a table game system that provides better visibility of a winning outcome for a game of chance.

In accordance with the above and the other aspects of the present disclosure, an improved table game system is provided. The table game system includes a table game surface and a random number generator for identifying one or more numbers relevant to determining an outcome of a game of chance. The table game surface includes a game layout, including a plurality of player positions disposed on the game layout and a plurality of wagering areas corresponding to different possible outcomes of the game of chance. Each wagering area includes at least one illumination source associated therewith that can be switched between an on condition and an off condition. Each at least one illumination source may be configured to switch to the on condition when the wagering area with which it is associated is a winning outcome.

BRIEF DESCRIPTION OF THE DRAWINGS

Other aspects of the present disclosure will be readily appreciated, as the same becomes better understood by reference to the following detailed description when considered in connection with the accompanying drawings wherein.

DETAILED DESCRIPTION OF THE DISCLOSURE

According to an aspect, the present disclosure relates to a table game system 10. More particularly, the present disclosure relates to a table game system 10 including a card shuffling device 12 that allows a card to be randomly drawn and where the selected card can determine an outcome of a game of chance. It will be appreciated that the card shuffling device 12 may be configured to select more than one card at a single time if such an event is needed to determine the outcome of the game of chance. It will also be appreciated that instead of a card shuffling device, any other suitable random number generator may be employed in accordance with the disclosed table game system. An exemplary card shuffling device is disclosed in Applicant's U.S. Pat. No. 7,669,853, entitled "Card Shuffling Device", which is hereby incorporated by reference, as though set forth fully herein.

Figure 1:
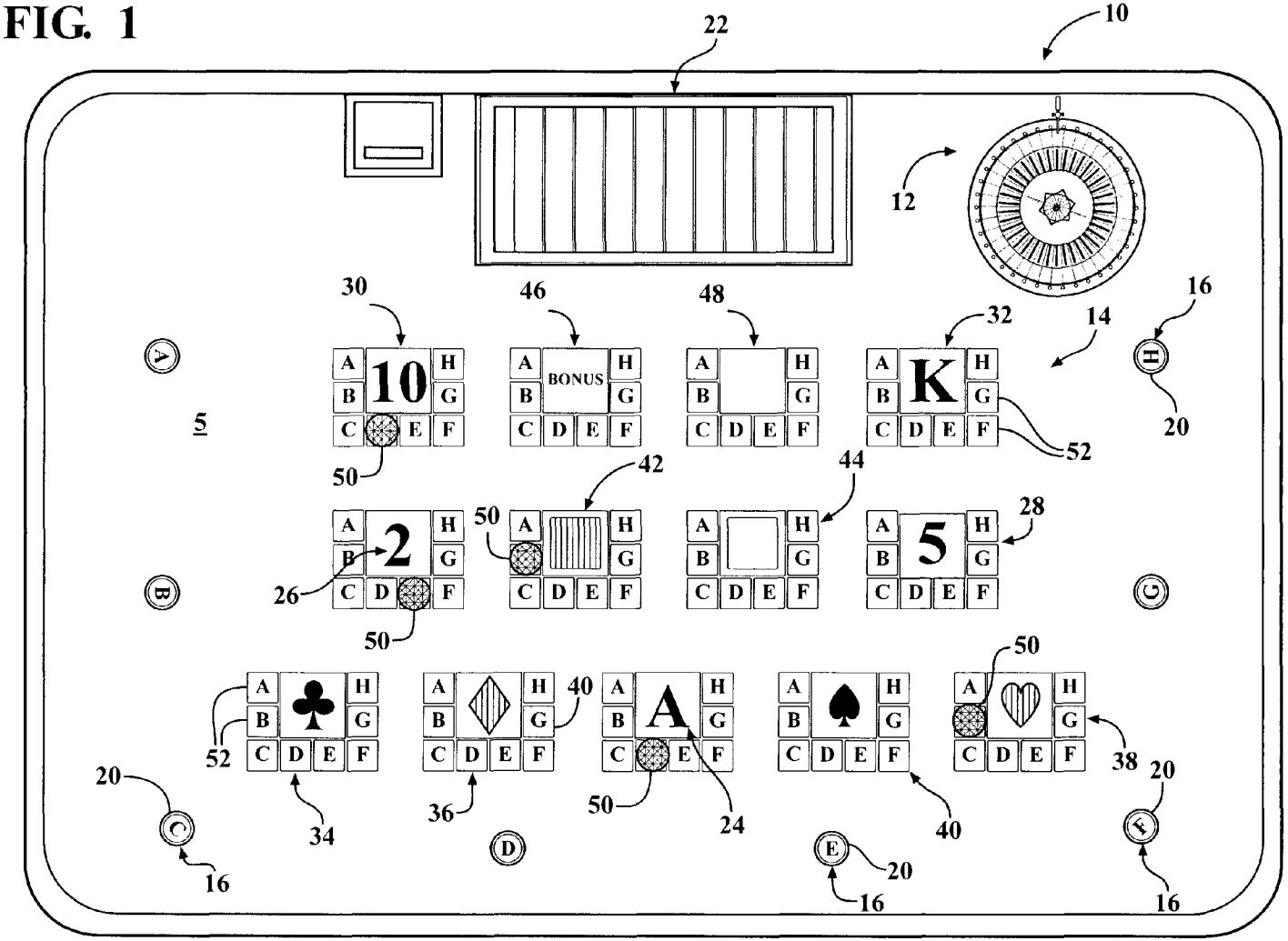
FIG. 1 is an exemplary table game layout for a game of chance in accordance with an aspect of the disclosure.
Figure 2:
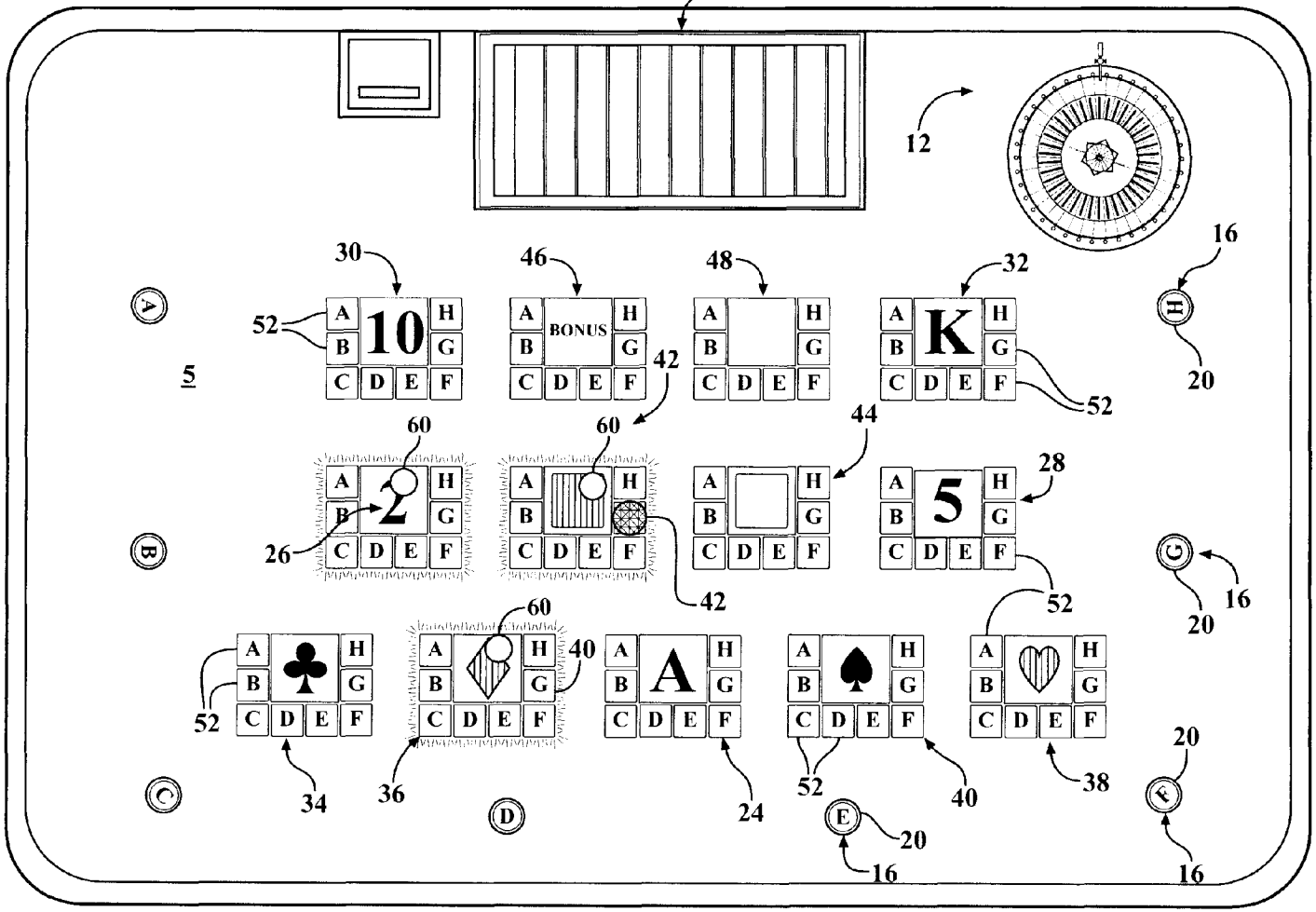
FIG. 2 is an exemplary table game layout for a game of chance with designated wagering areas illuminated in accordance with an aspect of the disclosure.

With reference to FIGS. 1 and 2, according to an aspect, the table game system 10 can include a table surface 5 with a game layout 14. According to an aspect, the game layout 14 may be disposed on an elevated table or other suitable structure. As shown, the game layout 14 can include a plurality of player positions 16 disposed on the table surface 5. The game layout 14 can also include a plurality of wagering areas, designated generally by 24-48. According to an aspect, the plurality of wagering areas 24-48 are the location where players may make specific bets by placing a wager in the wagering area at the location corresponding to their player position. It will be appreciated that the configuration of the wagering areas 24-48 may vary depending upon the game of chance being played. It will further be appreciated that the game layout 14 may take on a variety of different configurations with different wagering areas depending upon the rules for the game of chance being played. According to another aspect, the game layout 14 may be configured for the game of roulette. It will be appreciated that the game layout 14 could be configured for other games of chance, including craps or any other casino game where the random selection of one or more numbers can decide the outcome of the game of chance.

According to an exemplary aspect, the game layout 14 may be configured for the game of Mystery Card Bonanza, which is a table game available from Inag, Inc. of Minden, Nev. The rules for the game as well as the configuration of an exemplary card shuffling device 12 that may be used with the game of Mystery Card Bonanza are described in Applicant's U.S. Pat. No. 8,505,919, which is hereby incorporated by reference as though set forth fully herein.

Briefly, according to an aspect, the game can be played with a custom fifty four (54) card deck where they cards are placed in random order in the card shuffling device 12. It will be appreciated that other suitable random number generators may be employed. In summary, there are fifty-four total cards with fifty-two of them being normal playing cards and two of them being special cards. Of those normal playing cards, they are evenly distributed among the four suits (clubs, diamonds, hearts, spades) and the two colors (black, red). According to the exemplary aspect, twenty-four of the playing cards may have an ace (A) value, fifteen of the playing cards may have a deuce (2) value, seven of the playing cards may have a five (5) value, four of the playing cards may have a ten (10) value, and two of the playing cards may have a king (K) value. Additionally, thirteen of the cards may be suited clubs; thirteen of the cards may be suited diamonds; thirteen of the cards are suited hearts; thirteen of the cards may be suited spades. Further, twenty-six of the playing cards may be colored red while twenty-six may be colored black.

According to an aspect, the game layout 14 presents a plurality of sequentially ordered player positions 16 with each player position presenting unique player indicia 20. As shown in FIGS. 1 and 2, the exemplary indicia 20 may be sequentially ordered with the letters A through F. Alternatively, the indicia 20 could be numbers, colors, or any other distinct symbols. According to an aspect, up to eight players can be stationed at the playing surface with no more than one player being stationed at each of the player positions 16. Players can leave their player position 16 at any time between rounds and new players can take the vacated spots. The table game 10 can be played with as few as one player or as many players as there are player positions. It will be appreciated that the game layout 14 may include more or less player positions as desired. It will also be appreciated that multiple players could occupy a single player position. It will further be appreciated that the player positions could be identified by the player's location around the table.

The game layout 14 additionally can include a dealer position 22, which is distinct from the player positions. According to an aspect, the dealer position 22 may be located on one side of the game layout 14 and adjacent the card shuffling device 12. As will be appreciated, a live dealer may be positioned at the dealer position 22 for managing the table game system 10. It should be appreciated that the table game system can also be played electronically. In the electronic game, the game rules may be maintained on a computer which is configured to display a GUI of a game layout on a display and which allows one or more players to interact therewith in accordance with this disclosure. In accordance with the electronic aspect, the dealer and the dealer position may not be necessary. In accordance with a further aspect, the game system may be configured as an iGame within a casino, which includes a physical table, a live dealer and a physical random number generator. According to this aspect, the game system could include electronic terminals at each of the player positions, which would allow players at the table to place a wager on the outcome electronically. Depending upon the wager selected, a signal would be sent to illuminate that player's section in the wagering area to reflect the presence of their bet.

According to an aspect, the table game surface 14 may include a plurality of value wagering areas 24, 26, 28, 30, 32 where players may place a wager on the value of the winning card selected, a plurality of suit wagering areas 34, 36, 38, 40 where players can wager on the suit of the winning card selected, and a plurality of color wagering areas 42, 44 where players may place a wager on the color of the winning card selected. Additionally, the game layout 14 can present two special wagering areas 46, 48 where players can place a wager on the special cards. The players may use tokens 50 to place their wagers on the wagering areas. Any other suitable wagering areas may also be employed.

The value wagering areas 24, 26, 28, 30, 32 of the game layout 14 of the exemplary embodiment can include an aces wagering area 24, a deuces wagering area 26, a fives wagering area 28, a tens wagering area 30, and a kings wagering area 32. The suit wagering areas 34, 36, 38, 40 of the table game surface 14 can include a clubs wagering area 34, a diamonds wagering area 36, a hearts wagering area 38, and a spades wagering area 40. The color wagering areas 42, 44 may include a red wagering area 42 and a black wagering area 44. Additionally, according to an aspect, the game layout 14 can include a BONANZA wagering area 46 and an INAG wagering area 48 for allowing the players to place wagers on the BONANZA and INAG special cards respectively. In other words, there is a wagering area for each of the values, suits, and colors of the cards in the card shuffling device 12 as well as the two special cards. It will be appreciated that the cards corresponding to the wagering areas 46 and 48 could take on a variety of different indicia, such as jokers.

As shown, wagering area player indicia 52, which replicate each of the unique player indicia 20, may be affixed within the boundaries of each of the wagering areas 24-48 to provide a place for the respective players to place their wagers. During the game, each of the players may place tokens 50 on the indicia 52 of the wagering area matching the indicia 20 of the player's position. According to an aspect, the indicia 52 allow the dealer to discern the respective wagers without reliance upon the use of color. The players may place the tokens 50 on the indicia 52 or may hand them to the dealer who will place the wagers.

In accordance with an aspect, the card shuffling device 12 can randomly select at least one card to determine the outcome of the game of chance. Once the card has been identified or selected by the card shuffling device 12, the card could be removed from the shuffling device 12 and utilized to determine the outcome of the game of chance. Based on the outcome, any wagers placed in the wagering areas 24-48 can be resolved. According to an aspect, the selected card could be removed from the card shuffling device 12 by the dealer. Alternatively, the card could be removed automatically by a mechanical arm. According to a still further aspect, once the card is removed from the card shuffling device 12, the live dealer could place the card on the table for display and then resolve any wagers based on the indicia of the displayed card. Alternatively, the indicia of the card could be read, such as by a camera, an RF reader, or a bar code scanner, such that it is automatically input into a computer associated with the system 10.

Figure 3:
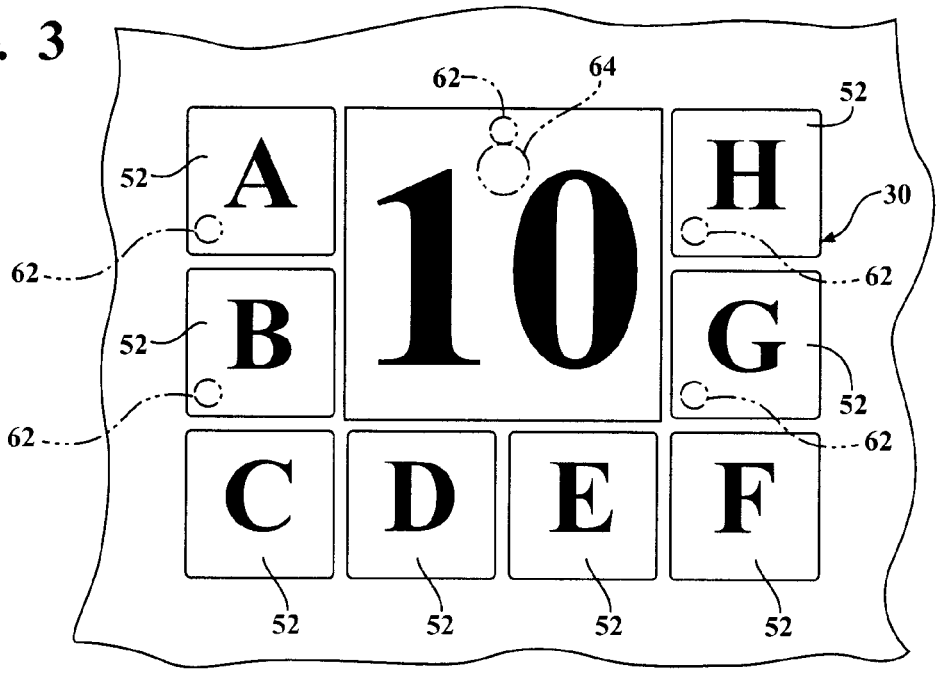
FIG. 3 is an enlarged illustration of a wagering area for the table game layout of FIG. 1.

According to an aspect, once the winning card has been selected, before resolving any wagers, the dealer can place a dolly marker 60 (FIGS. 2 and 3) in the wagering area corresponding to the value of the card selected from the card shuffling device 12, as is discussed in more detail below. According to another example, the marker 60 may be placed in a designated marker area 62 associated with each of the wagering areas corresponding to a winning outcome, as is best shown in FIG. 2. For example, the designated marker area 62 may be the center-portion of each the wagering areas. Alternatively, the designated marker area 62 may be one of the corners of each of the wagering areas. Still further, the designated marker area 62 may be disposed adjacent each of the respective wagering areas. According to a still further aspect, the game layout 14 may include a layout sensor 64 (FIG. 3) associated with each of the designated marker areas 62. For example, the layout sensor 64 could be disposed within or beneath the designated marker area 62. The layout sensor 64 could be any suitable sensor for accomplishing the aspects of the disclosure. The layout sensor 64 may be intended to communicate with the marker 60, as discussed below.

Figure 4:
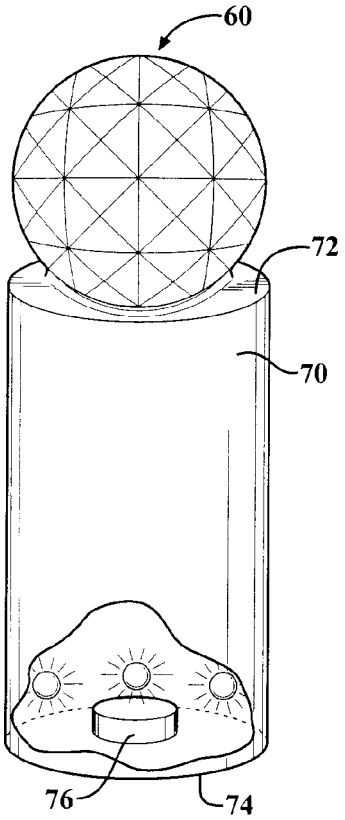
FIG. 4 is a schematic illustration of a dolly marker for use with a game of chance in accordance with an aspect of the disclosure.

According to another aspect, the marker 60 may be configured as shown in FIG. 4. Specifically, the marker 60 may have a body portion 70 with a top surface 72 and a bottom surface 74. The bottom surface 74 may be configured to be placed on the designated marker area 62 of the appropriate wagering area. According to still a further aspect, the marker 60 may include a marker sensor 76 housed therein that is intended to communicate with the layout sensor 64 associated with the designated marker area 62. According to an aspect, when the marker 60 is placed in the designated marker area 64, the marker sensor 76 can communicate with the layout sensor 64 to complete a circuit and illuminate the winning wagering area. It will be appreciated that the marker 60 may have any other suitable configuration. For example, instead of a dolly maker, one or more chips that are configured with a sensor may be employed to complete the circuit and illuminate the winning wagering area(s). Similarly, the marker sensor 76 may be any suitable sensor.

Each wagering area 24-48 can include an illumination source 78 in communication therewith. The illumination source 78 associated with a particular wagering area may be in communication with the marker sensor 76 associated with the respective wagering area. According to an aspect, when the marker sensor 76 is placed in communication with the layout sensor 64 associated with a particular wagering area, the illumination source 78 associated with that wagering area may be activated and thus illuminated to indicate a winning outcome. The illumination source 78 may normally be in an off condition. The illumination source 78 may be any suitable light source, such as an LED. According to an aspect, the illumination source 78 may consist of a strip of LEDs. However, a variety of other suitable illumination sources may be employed. The illumination source 78 may be disposed within the table game surface 14 such that when activated, it may be visible to players. Each illumination sources 78 may be configured to emit a variety of different colors or a variety of different effects, including pulsing or flashing. According to another aspect, the illumination source may be disposed within the marker body 70 such that when the layout sensor 64 and the marker sensor 76 are in communication with one another, the illumination source on the marker 60 lights up the appropriate wagering area to designate the winning outcomes. It will also be appreciated that the LEDs can be illuminated at all time, but may be configured to change colors when the marker is brought into communication with the sensor to indicate a winning outcome.

According to another aspect, the game layout 14 may be in communication with a computer such that when a winning card is selected, the dealer may input the indicia of the winning card into the computer. Pursuant to this aspect, based on the winning outcome, the computer, which is in communication with one or more light sources associated with the wagering areas, will cause the wagering areas that correspond to the winning outcome to illuminate by the light sources. All of these effects or a combination thereof could be employed as desired.

FIG. 2 schematically illustrates an example where the selected card that is removed from the card shuffling device 12 is the 2 of diamonds. In this example, one or more markers 60 may be disposed in each of the wagering area 26, the wagering area 36, and the wagering area 42. The markers 60 may be placed in the respective designated marker area 62 in each of the wagering areas. When this occurs, the illumination source associated with each of these areas may be switched to an on condition to light up the respective wagering area. Specifically, a marker 60 may be placed in the value wagering area 26 to reflect that any bets on the value of 2 are winning wagers. Additionally, a separate marker 60 may also be placed in the suit wagering area 36 to reflect that any bets on the suit being diamonds are winning wagers. Further, another marker 60 may be placed in the color wagering area 42 to reflect that any bets on the color red are also winning wagers. According to another aspect, a single marker could be employed a moved to the appropriate area as the wagers are being resolved. Alternatively, separate markers could be placed in each winning wagering are such that they are all illuminated at the same time. According to a still further aspect, illumination sources on each of the markers could be activated to illuminate the appropriate wagering areas.

Note that not all of the activities described above in the general description or the examples are required, that a portion of a specific activity may not be required, and that one or more further activities may be performed in addition to those described. Still further, the orders in which activities are listed are not necessarily the order in which they are performed.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Many other embodiments may be apparent to those of skill in the art upon reviewing the disclosure. Other embodiments may be used and derived from the disclosure, such that a structural substitution, logical substitution, or another change may be made without departing from the scope of the disclosure. Accordingly, the disclosure is to be regarded as illustrative rather than restrictive.

Certain features are, for clarity, described herein in the context of separate embodiments, may also be provided in combination in a single embodiment. Conversely, various features that are, for brevity, described in the context of a single embodiment, may also be provided separately or in any sub combination. Further, reference to values stated in ranges includes each and every value within that range.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The invention claimed is:

1. A table game system for a playing a game of chance, comprising:

a table surface;

a plurality of player positions disposed about the table surface with each of the plurality of player positions having a unique player identifier associated therewith;

a plurality of wagering areas disposed on the table surface, each of the plurality of wagering areas configured to receive a wager in the form of one or more betting chips on a unique outcome for the game of chance; each of the plurality of wagering areas including a plurality of player betting areas associated therewith, with each of the plurality of player betting areas including one of the unique player identifiers to represent a location for placement of the wager by the player position associated with that unique player identifier;

a random number generator associated with the table surface for identifying one or more numbers relevant to determining the outcome of the game of chance;

each of the plurality of wagering areas including a marker placement area that is discrete from the plurality of player betting areas and configured to receive a dolly marker identifying that wagering area as a winning outcome;

at least one sensor disposed in each of the marker placement areas and configured to communicate with the dolly marker only when the dolly marker is disposed in the marker placement area, and wherein the communication completes a circuit;

an illumination source in communication with the sensor for each of the wagering areas, each illumination source having a first mode of operation and a second mode of operation;

whereby each illumination source is configured to switch from the first mode of operation to the second mode of operation upon placement of the dolly marker on the at least one sensor in one of the plurality of wagering areas and establishment of communication between the at least one sensor and the dolly marker when the wagering area with which the illumination source is associated corresponds to the winning outcome.

2. The system of claim 1, wherein the random number generator is a card shuffling device that holds a plurality of cards with each of the plurality of cards having indicia corresponding to an outcome of the game of chance.

3. The system of claim 2, wherein the first mode of operation of the illumination source is an off condition and the second mode of operation of the illumination source is an on condition.

4. The system of claim 3, further comprising:

a plurality of player betting area sensors disposed adjacent the table surface and associated with each of the wagering areas, each of the plurality of player betting area sensors configured to communicate with a respective illumination source by completion of a circuit when the dolly marker is disposed in the marker placement area to effect a change in the mode operation.

5. The system of claim 2, wherein the first mode of operation of the illumination source is a first color and the second mode of operation of the illumination source is a second color.

6. The system of claim 4, wherein the plurality of player betting area sensors are configured to communicate with a marker sensor in the dolly marker only when the marker sensor is brought into communication with one of the player betting area sensors the communication completing a circuit to cause a respective one of the illumination sources to switch to the on condition.

7. The system of claim 6, wherein the marker sensor is disposed in a chip marker.

8. The system of claim 6, wherein the illumination sources are LEDs.

9. The system of claim 2, wherein at least one of the plurality of wagering areas is configured to receive a wager on a color of an identified card.

10. The system of claim 2, wherein at least one of the plurality of wagering areas is configured to receive a wager on a suit of an identified card.

11. The system of claim 2, wherein at least one of the plurality of wagering areas is configured to receive a wager on a number of an identified card.

12. The system of claim 1, wherein each illumination source is in communication with a controller and is configured to switch from one mode of operation to another upon entry of indicia of the selected card into the controller.

13. A table game system for playing a game of chance, comprising:

a table surface having a plurality of wagering areas disposed thereon, each of the plurality of wagering areas associated with a unique outcome of the game of chance and configured to receive a wager in the form of one or more betting chips from one or more players;

a card shuffling device which can hold a plurality of cards with each of the plurality of cards having indicia for determining an outcome of the game of chance; and a wagering area sensing device associated with each of the plurality of wagering areas and configured to communicate by completion of a circuit with a marker device having a marker sensor;

an illumination source having a first state of operation operable when the wagering area sensing device is not in communication with the marker device and a second state operable when the wagering area sensing device is in communication with the marker device with the second state reflective of a winning outcome of the game of chance.

14. The system of claim 13, wherein the first state of the illumination source is an on condition and the second state of the illumination source is an off condition.

15. The system of claim 14, wherein the illumination source is disposed on the marker device.

16. The system of claim 14, wherein the illumination source is incorporated into the table surface.

17. The system of claim 13, wherein the marker device is a dolly marker.

18. The system of claim 13, wherein the marker device is a chip marker, which is discrete from the one or more betting chips.

19. The system of claim 13, wherein the illumination source is an LED.

20. The system of claim 13, wherein the plurality of wagering areas allow for placement of a wager associated with each of a color of the identified card, a suit of the identified card, and a number of the identified card.

21. A table game system for playing a game of chance, comprising:

a table surface having a plurality of wagering areas disposed thereon, each of the plurality of wagering areas associated with an outcome of the game of chance and configured to receive a wager from one or more players;

a card shuffling device configured to hold a plurality of cards with each of the plurality of cards having indicia for determining an outcome of the game of chance an illumination device associated with each of the wagering areas, each illumination device having a first mode of operation and a second mode of operation;

a sensor device disposed adjacent each of the plurality of wagering areas and in communication with a respective one of the illumination devices;

whereby the sensor device is configured to cause the illumination device to switch from the first mode of operation to the second mode of operation upon the sensor being triggered by placement of a dolly marker in one of the plurality of wagering areas which completes a circuit to identify that wagering area as a winning outcome;

whereby the illumination source is disposed in the dolly marker.

22. The system of claim 21, wherein the first condition of the illumination source is an on condition and the second condition of the illumination source is an off condition.

23. The system of claim 21, wherein the first condition of the illumination source is a first color and the second condition of the illumination source is a second color.

24. The system of claim 21, wherein the first condition of the illumination source is one lighting effect and the second condition of the illumination source is a second lighting effect.

25. The system of claim 21, wherein each of the plurality of wagering areas includes indicia associated with each of a plurality of player positions.

* * * * *